United States Patent [19]

Kendall et al.

[11] Patent Number: 4,878,861

[45] Date of Patent: Nov. 7, 1989

[54] COMPLIANT ELECTRICAL CONNECTOR PIN

[75] Inventors: Jerry A. Kendall; David M. Webb, both of Lewisville, Tex.

[73] Assignee: Elfab Corporation, Lewisville, Tex.

[21] Appl. No.: 265,782

[22] Filed: Nov. 1, 1988

[51] Int. Cl.[4] ..... H01R 13/42

[52] U.S. Cl. ..... 439/751; 439/82

[58] Field of Search ..... 439/82, 751

[56] References Cited

U.S. PATENT DOCUMENTS

| | | | |
|---|---|---|---|
| 3,601,750 | 8/1971 | Mancini | 339/17 C |
| 4,110,904 | 9/1978 | Johnson | 29/628 |
| 4,186,982 | 2/1980 | Cobaugh et al. | 339/17 C |
| 4,274,699 | 6/1981 | Keim | 439/751 X |
| 4,475,780 | 10/1984 | Walter et al. | 339/17 C |
| 4,533,204 | 8/1985 | Moynagh, Jr. et al. | 339/221 R |
| 4,548,450 | 10/1985 | Reimer et al. | 339/17 C |
| 4,557,539 | 12/1985 | Zust et al. | 339/17 C |
| 4,585,293 | 4/1986 | Czeschka et al. | 339/221 R |
| 4,596,437 | 6/1986 | Rush | 339/221 R |
| 4,606,589 | 8/1986 | Elsbree, Jr. et al. | 339/17 C |
| 4,684,200 | 8/1987 | Capp | 439/387 |
| 4,691,979 | 9/1987 | Manska | 439/82 |
| 4,723,925 | 2/1988 | Orr, Jr. et al. | 439/877 |
| 4,728,164 | 3/1988 | Lemmens et al. | 439/82 X |
| 4,733,465 | 3/1988 | Tanaka | 29/874 |
| 4,740,166 | 4/1988 | Barnhouse | 439/82 |
| 4,762,498 | 8/1988 | Harting et al. | 439/82 |
| 4,793,817 | 12/1988 | Hiesbock | 439/82 |

*Primary Examiner*—Eugene F. Desmond

*Attorney, Agent, or Firm*—Weingarten, Schurgin, Gagnebin & Hayes

[57] ABSTRACT

A compliant electrical connector pin for press-fit connection to a plated hole in a circuit board is disclosed. A compliant section is provided on the pin to frictionally engage the hole walls, thereby retaining the pin within the hole. The compliant section includes two V-shaped troughs having flat bottom faces. These faces define a web which compresses when the compliant section is pressed into the hole. Barrier walls in the bottom of each trough normal to the flat bottom face guide the compression of the web and prevent the web from splitting or shearing. The sides of the trough define two flanges, the exterior of which contact the hole in the circuit board. The outer corners of the flanges are angled to match more closely the circular shape of the hole, thereby reducing hole damage from sharp corners on the compliant section and enabling the pin to fit smaller diameter holes.

7 Claims, 2 Drawing Sheets

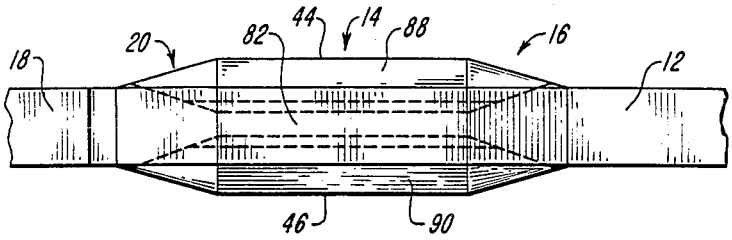
FIG. 4
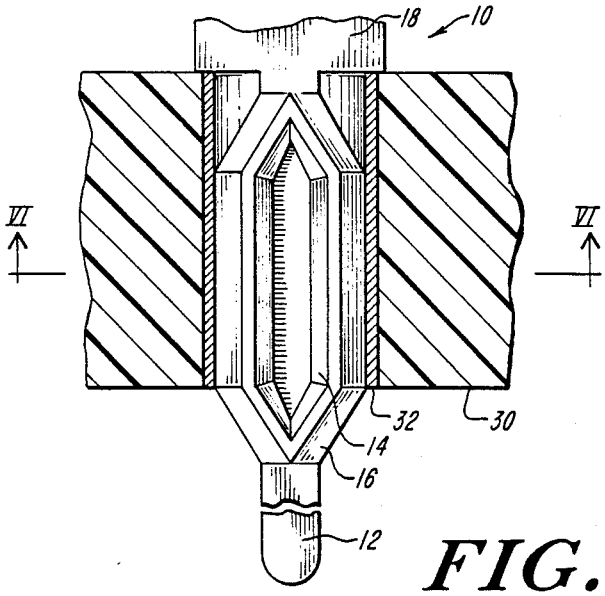
FIG. 5
FIG. 6
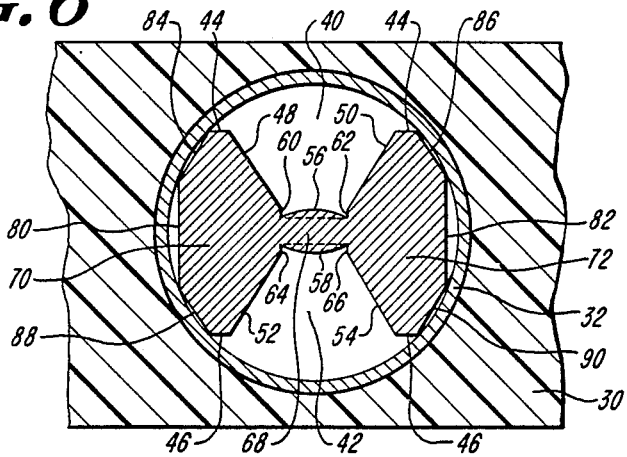

COMPLIANT ELECTRICAL CONNECTOR PIN

FIELD OF THE INVENTION

This invention relates to electrical connector pins and more particularly to compliant electrical connector pins for press-fit connection to a hole in a circuit board.

BACKGROUND OF THE INVENTION

One type of connection to provide electrical contact between a printed circuit board and another device uses a pin formed of electrically conductive material which is inserted into a plated-through hole in the circuit board. Often, the pin is soldered into the hole to maintain a good electrical connection between the pin and the hole. However, for some applications, pins which may be removed and reinserted repeatedly are desirable. Removal of the pin is inconvenient and time consuming if the connection has been soldered.

One type of removable connection known in the prior art is the press-fit connection. With this connection, the pin is pressed into the hole in the circuit board and retained therein by frictional engagement between the pin and the hole walls. However, the pin may also be removed upon application of sufficient force.

Press-fit pins must remain in the hole under most conditions and maintain good electrical contact with the plating of the hole, yet must be removable if necessary without damaging or destroying either the pin or the hole. One attempt known in the prior art to meet these requirements has been to utilize pins with a compliant portion which yields slightly upon being forced into the hole. See for example, U.S. Pat. No. 4,728,164 to Lemmens et al., U.S. Pat. No. 4,733,465 to Tanaka, or U.S. Pat. No. 4,740,166 to Barnhouse. These prior art pins have a configuration providing one or more hinge areas that bend or flex as the pin is inserted in the hole, allowing the pin to compress to fit into the hole.

A disadvantage to configurations that bend or flex is that the pin can shear or split near the flexure area. Shearing or splitting is especially a problem if the pin is forced into a hole that is too small, overstressing the pin. Additionally, the pin can damage the plating in the circuit board hole by repeated movement of the pin's exterior surfaces relative to the plating as the pin flexes. Such movement can occur from thermal expansion and contraction due to temperature changes or from physical forces exerted on the pin, as when the pin is being inserted or removed. Eventually, the plating and even the pin itself can degrade so that a good electrical contact can no longer be maintained. The substrate of the circuit board may also be damaged.

SUMMARY OF THE INVENTION

The present invention provides a compliant electrical connector pin which minimizes splitting or shearing when compressed into a hole in a circuit board. The connector of the present invention additionally minimizes damage to the plating on the circuit board hole and to the circuit board substrate. The present connector further maintains a good electrical contact within a wide range of hole diameters.

The connector of the present invention comprises a pin having a compliant section and a tail section. The tail section extends beyond the circuit board and may be connected to other contacts. The compliant section is formed for press-fit engagement within a plated hole in a printed circuit board. The compliant section, of larger cross-sectional area than the tail section, is joined to the tail section by a tapered transition section.

Two generally V-shaped troughs are formed in opposing faces of the compliant section. The troughs have generally flat bottom faces. The area between the bottom faces of each trough defines a web member. Two flange members, interconnected by the web member, are defined by the V-shaped sidewalls of the troughs and the exterior surfaces of the compliant section. When the compliant section is pressed into a hole, the compression is taken by the web member as it is pressed between the two flange members The web expands outwardly into the space within the two V-shaped troughs. Virtually no bending occurs to shear or split the compliant section.

Additionally, the pin includes barrier walls adjacent to the flat bottom faces of the troughs. The barrier walls guide the direction of expansion of the web member into the space between the walls of the trough. They also prevent the pin from splitting or shearing.

Finally, the outer corners of the flanges are angled to shape the compliant section of the pin more closely to the circular shape of the hole. This angling provides a better fit between the pin and the hole and minimizes sharp corners which can damage the hole.

DESCRIPTION OF THE DRAWINGS

The invention will be more fully understood from the following detailed description taken in conjunction with the accompanying drawings in which:

FIG. 4 is a side view of the connector of FIG. 1;

FIG. 5 is a partial cross-sectional view of the connector of FIG. 1 inserted in a hole in a printed circuit board; and FIG. 6 is a cross-sectional view of the connector taken along line VI—VI in FIG. 5.

DETAILED DESCRIPTION OF THE INVENTION

Figure 1:
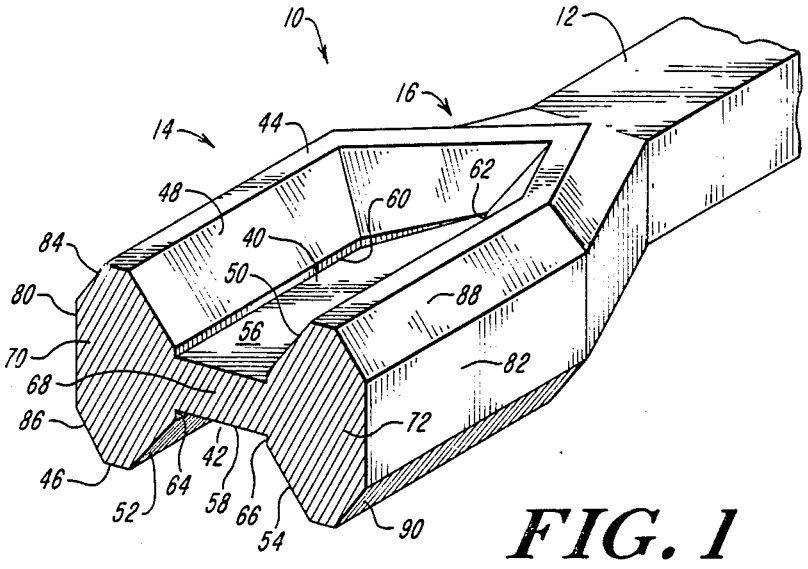
FIG. 1 is a partial perspective view of the connector of the present invention.

The present invention provides a compliant electrical connector pin for press-fit engagement with a hole in a circuit board. The pin 10 is shown generally in FIGS. 1 and 2. The pin comprises a tail section 12 and a compliant section 14. A transition section 16 joins the compliant section 14 to the tail section 12. A shoulder 18 is formed on the pin at the other end of the compliant section 14 and may be joined to the compliant section 14 by another transition section 20.

FIG. 5 shows the pin inserted in a hole in a circuit board 30. The hole is plated with a conductive material 32. The tail section 12 of the pin is inserted through the hole. The transition section 16 first encounters the hole walls and eases the compliant section 14 into contact with the hole. The shoulder 18 rests on the circuit board 30, distributing stress more evenly and acting as a stop for the pin 10. The tail section 12 protrudes from the board and may be attached to other contacts.

Figure 3:
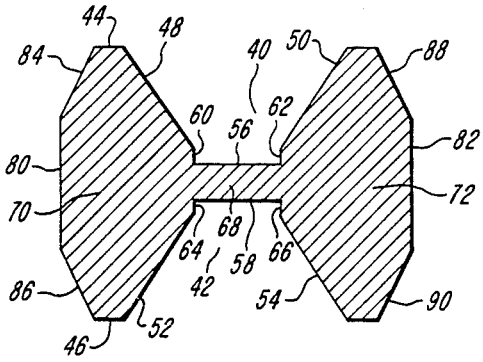
FIG. 3 is a cross-sectional view of the connector taken along line III—III of FIG. 2.

FIGS. 1 and 3 show the cross-sectional configuration of the pin of the present invention. Two generally V-shaped troughs 40, 42 are formed in opposing faces 44, 46 of the pin's compliant section. The sidewalls 48, 50, 52, 54 of the troughs are angled, giving the trough a general V-shape. The bottom of the troughs 40, 42 comprise generally flat bottom faces 56, 58 and upstanding barrier walls 60, 62, 64, 66.

The faces 56, 58 of the bottoms of the two troughs 40, 42 define between them a webbed member 68. The trough sidewalls 48, 50, 52, 54 define two flange members 70, 72 connected by the web member 68. The flanges 70, 72 include exterior side faces 80, 82. The exterior corners 84, 86, 88, 90 between side faces 80, 82 and opposing faces 44, 46 are angled so that the exterior configuration of the compliant section more closely approximates a circle.

Figure 2:
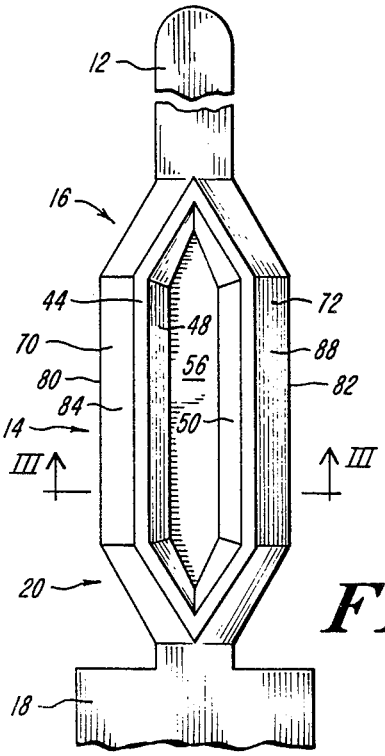
FIG. 2 is a plan view of the connector of FIG. 1.

The transition section 16 is best shown in FIGS. 1, 2, and 4. The section is tapered from the wider compliant section 14 to the narrower tail section 12. The troughs 40, 42, the sidewalls 48, 50, 52, 54, and barrier walls 60, 62, 64, 66 extend into the transition section 16 and taper to a termination. The transition section is the first section to encounter the hole walls and reduces resistance to the initial compressive forces on the compliant section. A similar tapered transition section 20 may be provided on the other end of the compliant section 14.

FIGS. 5 and 6 show the compliant pin inserted in a hole in the circuit board. The exterior angled corners 84, 86, 88, 90 provide greater surface contact between the compliant section and the plating 32 in the hole, ensuring a good electrical contact. The angled walls also give the outer configuration a generally circular shape, minimizing sharp corners which could cut and damage the plating 32.

Once the pin is inserted into the hole, as shown in FIG. 6, the web member 68 is compressed between the two flange members 70, 72. The web member 68 expands outwardly into the two troughs 40, 42. The bottom faces 56, 58 of the troughs 40, 42 bulge as a result of this expansion. The dotted lines in FIG. 6 show the uncompressed state of the web member 68. The barrier walls 60, 62 and barrier walls 64, 66 each provide space into which the bottom faces may bulge. In addition, the barrier walls limit or guide the expansion into this space by preventing the web member 68 from twisting or flexing in another direction relative to the flanges 70, 72. Thus, shearing or splitting of the compliant section is minimized or eliminated. Since the pin can withstand greater compressive stresses than shear stresses, the compliant pin of the present invention can be pressed into smaller holes with less damage to the pin than is possible with prior art compliant pins.

The compliant pin of the present invention may be inserted into a finished plated hole of 0.040 ±0.003 inches with a force of no greater than 45 pounds and may be removed from the hole with a force of at least 7.5 pounds without damaging the hole or adjacent substrate.

The invention is not to be limited by what has been particularly shown and described, except as indicated by the appended claims.

I claim:

1. A compliant electrical connector pin for press-fit connection to a hole in a circuit board, the pin comprising:

a tail section; and an enlarged compliant section of generally rectangular cross-section, two generally V-shaped troughs formed in opposing faces of the compliant section to form two flange members, each trough having a bottom, including a generally flat bottom face, the flat bottom faces of the troughs forming therebetween a compressible web member connecting the two flange members, and the bottom of each trough further intersects barrier walls extending substantially normal to the generally flat bottom face.

2. The pin of claim 1, wherein each flange member includes two outer corners, each corner being angled to provide added surface area for contacting the hole in the circuit board.

3. The pin of claim 1, further comprising:

a tapered transition section between the tail section and the compliant section, the two generally V-shaped troughs extending into the transition section and tapering to a termination.

4. A compliant electrical connector pin for press-fit connection to a hole in a circuit board, the pin comprising:

a tail section;

a neck section;

an enlarged compliant section interposed between the tail section and the neck section, the compliant section comprising two flange members and a compressible web member interconnecting the flange members, the flange members and the web member thereby forming two generally opposed troughs, each trough having a bottom including a generally flat bottom face defining the web, each trough further including generally V-shaped sidewalls defining interior walls of the flange member, the sidewalls extending outwardly from the bottom of the trough to an exterior surface of the flange member, each interior wall including a barrier wall extending in a substantially normal direction from the generally flat bottom face.

5. The pin of claim 4, wherein each flange member includes two outer corners, each corner being angled to provide added surface area for contacting the hole in the circuit board.

6. The pin of claim 4, further comprising a tapered transition section between the tail section and the compliant section, the two troughs extending into the transition section and tapering to a termination.

7. A compliant electrical connector pin for press-fit connection to a hole in a circuit board, the pin comprising:

a tail section;

a neck section;

an enlarged compliant section interposed between the tail section and the neck section, the compliant section comprising two flange members and a compressible web member interconnecting the flange members, the flange members and the web member thereby forming two generally opposed troughs, each trough having a bottom including a bottom face defining the web, the bottom face being substantially flat when the web is uncompressed, each trough further including generally V-shaped sidewalls defining interior walls of the flange member, the sidewalls extending outwardly from the bottom of the trough to an exterior surface of the flange member, the bottom and each sidewall intersecting substantially along a straight line to define an angle therebetween, the web being compressible between the two flange members and expandable to bow the bottom faces outwardly into the two troughs upon insertion of the compliant section into the hole in the circuit board.

* * * * *